US007735559B2

(12) United States Patent
Malone

(10) Patent No.: US 7,735,559 B2
(45) Date of Patent: Jun. 15, 2010

(54) SYSTEM AND METHOD TO FACILITATE TREATMENT AND PRODUCTION IN A WELLBORE

(75) Inventor: Bradley P. Malone, Manhattan, KS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 101 days.

(21) Appl. No.: 12/106,809

(22) Filed: Apr. 21, 2008

(65) Prior Publication Data

US 2009/0260815 A1 Oct. 22, 2009

(51) Int. Cl.
*E21B 43/14* (2006.01)
*E21B 43/26* (2006.01)
*E03B 3/18* (2006.01)

(52) U.S. Cl. ..... 166/313; 166/227; 166/308.1; 166/325

(58) Field of Classification Search ..... 166/386, 166/325–329, 227, 308.1, 177.5, 313, 191
See application file for complete search history.

(56) References Cited

U.S. PATENT DOCUMENTS 4,917,191 A 4/1990 Hopmann et al.
5,305,833 A 4/1994 Collins
5,551,514 A 9/1996 Nelson et al.
RE36,466 E 12/1999 Nelson et al.
6,172,011 B1 1/2001 Card et al.
6,394,184 B2 5/2002 Tolman et al.
6,450,260 B1 9/2002 James et al.
6,534,449 B1 3/2003 Gilmour et al.
6,543,538 B2 4/2003 Tolman et al.
6,722,439 B2 4/2004 Garay et al.
6,732,800 B2 5/2004 Acock et al.
6,755,257 B2 6/2004 Spencer et al.
6,758,272 B2 7/2004 Bixenman et al.
6,776,239 B2 8/2004 Eslinger et al.
6,782,948 B2 * 8/2004 Echols et al. ..... 166/278
6,789,624 B2 9/2004 McGregor et al.
6,828,280 B2 12/2004 England et al.
6,837,309 B2 1/2005 Boney et al.
6,883,608 B2 4/2005 Parlar et al.
6,907,936 B2 6/2005 Fehr et al.
6,932,157 B2 8/2005 McGregor et al.
6,938,693 B2 9/2005 Boney et al.
6,957,701 B2 10/2005 Tolman et al.
6,961,663 B2 11/2005 Sinclair et al.
6,983,795 B2 1/2006 Zuklic et al.
7,021,384 B2 4/2006 Themig
7,059,407 B2 6/2006 Tolman et al.
7,066,260 B2 6/2006 Sullivan et al.
7,100,691 B2 9/2006 Nguyen et al.
7,108,067 B2 9/2006 Themig et al.
7,128,152 B2 10/2006 Anyan et al.
7,128,160 B2 10/2006 Anyan et al.

(Continued)

*Primary Examiner*—Kenneth Thompson
(74) *Attorney, Agent, or Firm*—David G. Matthews; Rodney V. Wafford; Tim Curington

(57) ABSTRACT

A technique enables simultaneous deployment of both treatment equipment and screen assemblies for use during production. The technique utilizes a multi-stage well treatment system deployed in a wellbore to enable treatment of a plurality of sections along the wellbore. Additionally, a plurality of screen assemblies are positioned at the plurality of sections, and each screen assembly comprises a valve to control the flow of fluids through the screen assembly.

16 Claims, 3 Drawing Sheets

U.S. PATENT DOCUMENTS

| | | | | |
|---|---|---|---|---|
| 7,134,493 | B2 | 11/2006 | Runia | |
| 7,134,505 | B2 | 11/2006 | Fehr et al. | |
| 7,185,703 | B2 | 3/2007 | Jannise et al. | |
| 7,207,388 | B2 | 4/2007 | Samuel et al. | |
| 7,240,739 | B2 * | 7/2007 | Schoonderbeek et al. | 166/386 |
| 7,243,723 | B2 | 7/2007 | Surjaatmadja et al. | |
| 7,243,724 | B2 | 7/2007 | McGregor et al. | |
| 7,296,624 | B2 | 11/2007 | Rodet et al. | |
| 2003/0127227 | A1 | 7/2003 | Fehr et al. | |
| 2003/0141060 | A1 * | 7/2003 | Hailey et al. | 166/278 |
| 2004/0118564 | A1 | 6/2004 | Themig et al. | |
| 2004/0129422 | A1 | 7/2004 | Themig | |
| 2005/0126787 | A1 | 6/2005 | Gomez | |
| 2005/0178552 | A1 | 8/2005 | Fehr et al. | |
| 2006/0090906 | A1 | 5/2006 | Themig | |
| 2007/0007007 | A1 | 1/2007 | Themig et al. | |
| 2007/0144746 | A1 | 6/2007 | Jonas | |
| 2007/0151734 | A1 | 7/2007 | Fehr et al. | |
| 2007/0256826 | A1 | 11/2007 | Ceccarelli et al. | |

* cited by examiner

SYSTEM AND METHOD TO FACILITATE TREATMENT AND PRODUCTION IN A WELLBORE

BACKGROUND

Fracturing operations are conducted in a well to improve the flow of production fluid from a surrounding formation into a wellbore. A variety of fracturing techniques can be employed, and available systems enable multi-stage stimulation to be performed along the wellbore. The fracturing techniques involve pumping a fracturing fluid downhole and into the surrounding formation to ultimately improve the flow of production fluids through the formation and into the wellbore.

In a separate procedure, a sand control completion can be deployed in the wellbore. The sand control completion facilitates production of a fluid, e.g. oil, from the wellbore as the fluid flows into the wellbore from the surrounding formation. Sand control features filter the fluid flowing into the wellbore to remove particulates. The filtering can be accomplished by sand screens and/or gravel packs. For example, a completion with sand screens can be deployed in the wellbore, and a gravel pack can be formed in the annulus surrounding the completion to filter the inflow of production fluid.

SUMMARY

In general, the present invention provides a system and method that enables simultaneous deployment of both fracturing equipment and screen assemblies for use during production. A well system comprises a multi-stage treatment system deployed in a wellbore to enable treatment, e.g. fracturing, of a plurality of sections/regions along the wellbore. The well system also comprises a plurality of screen assemblies positioned at the plurality of sections/regions. Each screen assembly comprises a valve to control the flow of, for example, production fluids through the screen assembly from the surrounding formation.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method to facilitate well treatments, e.g. fracturing treatments, as well as the subsequent production of fluid from the treated well. Generally, a well system is run into a wellbore and actuated to isolate a plurality of sections along the wellbore. The well system comprises flow valves that can be used to inject treatment fluid, e.g. fracturing fluid, into each of the sections. The well system also comprises a plurality of screen assemblies through which production fluid, for example, can flow into the well system following the treatment procedure. Each screen assembly also may comprise an isolation valve that can be used to selectively reduce or block flow through individual screen assemblies at specific isolated sections along the wellbore.

The well system comprises a multi-stage system having a series of isolation devices, e.g. packers, deployed in the wellbore to isolate sections of the wellbore. The packers can be used in either cased hole or open hole completions to divide the well into manageable sections. These manageable sections enable stimulation, and later production, that is specific to intervals bounded by pairs of packers.

Additionally, the well system can be used to carry out a variety of well treatment procedures in many types of wells, including vertical wells and deviated wells, e.g. horizontal wells. The well system also can be utilized in open hole and cased hole applications in many types of well environments, including high-temperature environments, high-pressure environments, $H_2S$ environments, and $CO_2$ environments. The treatment and production operations can be carried out in sandstone, carbonate, shale, coal or other types of formations.

In some embodiments of the invention, balls, darts or other suitable devices, may be dropped into the wellbore, or any conduit dispatched therein, to close off flow. In some instances, the balls, darts or other suitable devices may be received downhole by a seat, such as a ball seat for a ball. As used herein, the term "seat" or "ball seat" means a temporary pressure seal seat that allows an object to land and provide a temporary pressure seal to shift dynamically. Such seats may also optionally be shifted mechanically by use of a wire or tubular string to apply upward or downward force to mechanically shift the sleeve open or closed, and as such, would not be limited to solely dynamical shifting applications.

Figure 1:
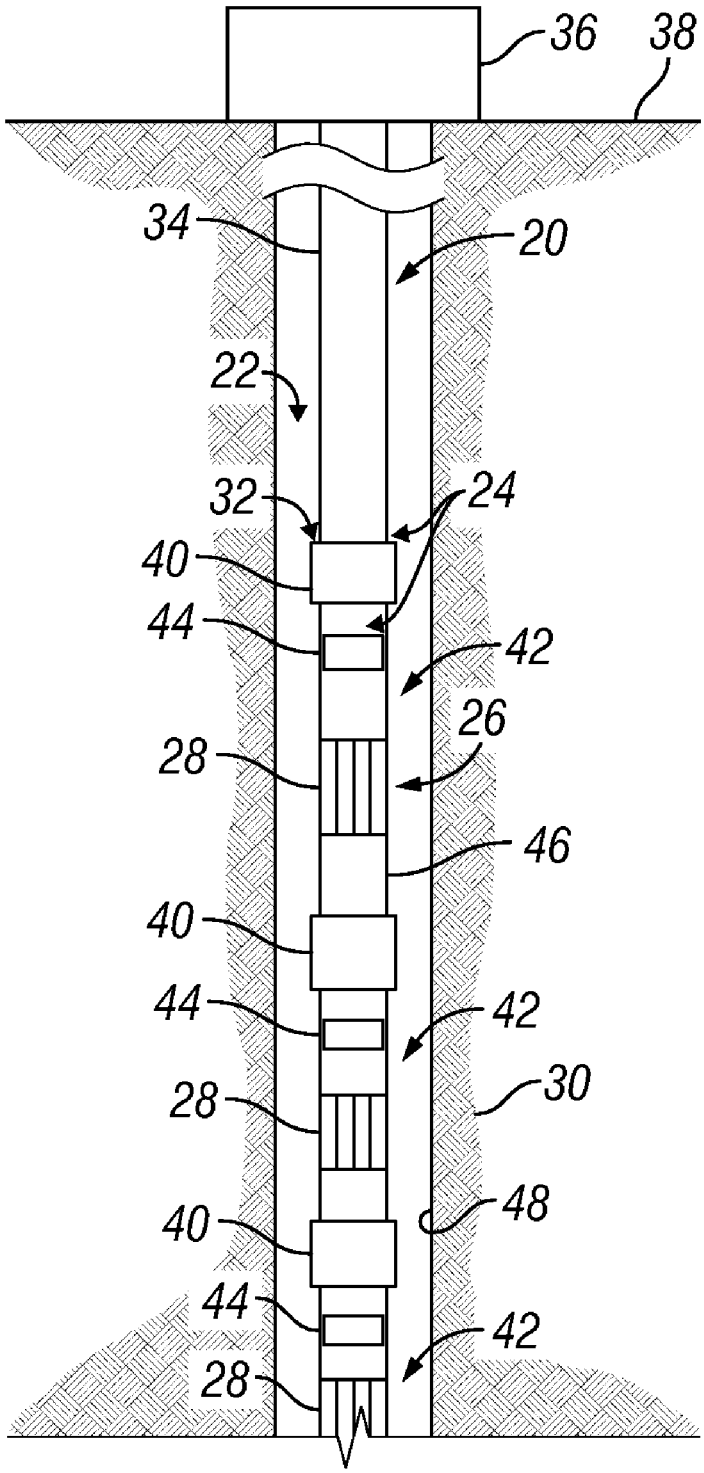
FIG. 1 is a schematic front elevation view of a well system deployed in a wellbore, according to an embodiment of the present invention.

Referring generally to FIG. 1, one embodiment of a well system 20 is illustrated as deployed in a wellbore 22. The well system 20 is designed to carry out well treatment procedures and sand control to facilitate production. As illustrated, well system 20 comprises a multi-stage treatment system 24 combined with a sand control system 26 having screen assemblies 28 that serve as the primary flow path into wellbore 22 and well system 20 from a surrounding formation 30.

The multi-stage treatment system 24 and the sand control system 26 are combined in a single tubing string/completion 32 deployed in wellbore 22 via a conveyance 34, such as tubing. In the example illustrated, well system 20 is deployed into a generally vertical well extending down from a surface rig 36 or other deployment equipment positioned at a surface location 38. However, well system 20 also can be deployed into deviated wellbores, such as horizontal wellbores.

Multi-stage treatment system 24 comprises a plurality of isolation devices 40, e.g. packers, that can be actuated to isolate sections 42 along wellbore 24. The multi-stage treatment system 24 further comprises a plurality of flow valves 44 with at least one flow valve 44 disposed in each section 42 between adjacent packers 40. The flow valves 44 can be used to direct/inject treatment fluid into each isolated well section 42 during a treatment procedure. For example, flow valves 44 can be used to direct a fracturing fluid into the surrounding formation 30 at each well section 42 to fracture the desired formation zones, thereby promoting the flow of production fluids to wellbore 22. In many applications, the treatment procedure is conducted at individual well sections 42 and progresses from one well section 42 to the next. In a specific application, the multi-stage treatment system 24 is used to conduct a well stimulation procedure by placing the flow valves 44 between external packers 40 at multiple well sections 42. The packers 40 function to divide the well into manageable sections that enable stimulation and production specific to the interval bounded by packers at each end of that interval/well section. Examples of stimulation procedures include matrix stimulation, acid fracturing stimulation, and propped fracturing stimulation.

Upon completion of the treatment procedure, production fluid can be flowed from the various regions of formation 30 into screen assemblies 28 at each isolated well section 42. In the embodiment illustrated, packers 40, flow valves 44, and screen assemblies 28 are mounted on a tubular structure 46. The tubular structure 46 can be used to conduct treatment fluids to flow valve 44 and also to receive production fluids, e.g. oil, through screen assemblies 28.

In FIG. 1, packers 40 have been deployed into wellbore 22 and are ready for actuation against the surrounding wellbore wall 48. Depending on the specific application, wellbore wall 48 may be the wall in an open wellbore or a casing in a cased wellbore. In an open wellbore, packers 40 comprise open wellbore packers that can be set against an uncased wellbore. However, packers 40 also can be selected for actuation against a wellbore casing. In the latter example, perforations are formed through the wellbore casing at each isolated wellbore section 42 to enable flow between the formation 30 and wellbore 22.

Figure 2:
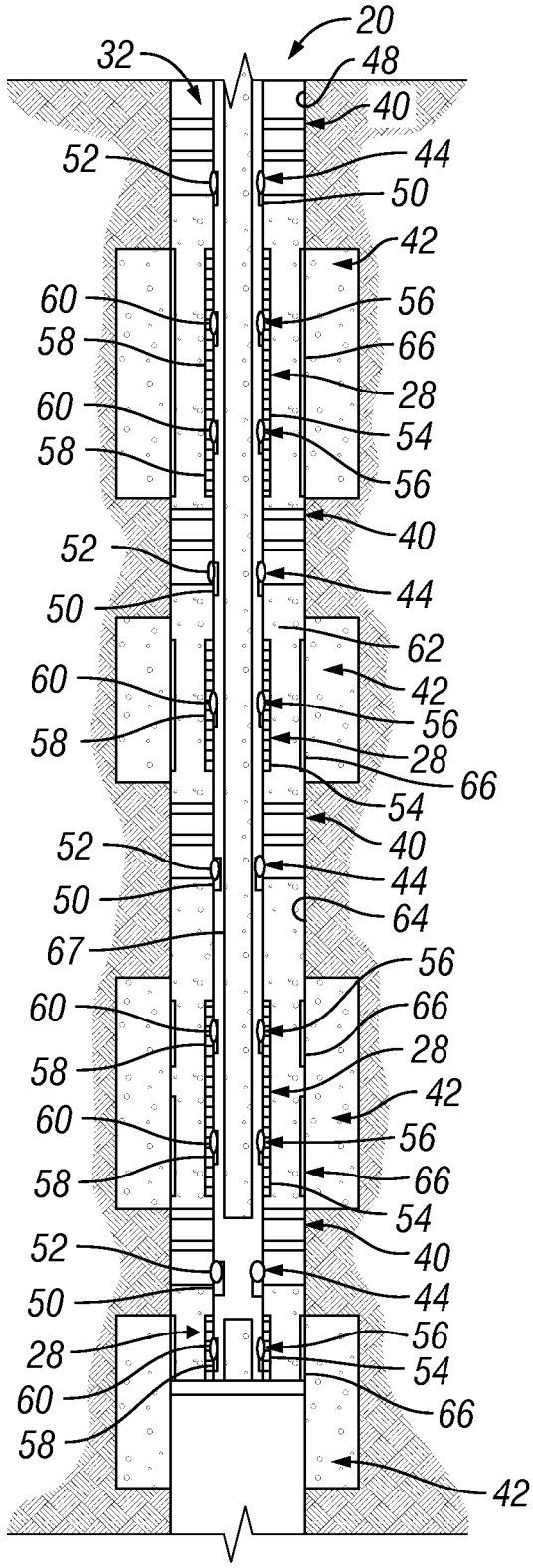
FIG. 2 is a schematic illustration of one example of the well system in which both treatment fluid flow valves and screen assemblies are positioned in the wellbore in a single well system, according to an embodiment of the present invention.

Referring to FIG. 2, one embodiment of well system 20 is illustrated in greater detail. As illustrated, the packers 40 have been actuated and expanded against wellbore wall 48 to isolate well sections 42. In this embodiment, each flow valve 44 comprises a sliding sleeve 50 and a ball seat 52 that works in cooperation with the sliding sleeve 50 to close off flow via balls dropped down through tubing string 32. The sliding sleeve 50 can be actuated to block fluid flow from inside tubing string 32 to the surrounding formation 30 within specific well sections 42. The balls also can be used to block flow along tubing string 32 between isolated well sections 42. In some embodiments, the ball seats 52 have different diameters from one flow valve 44 to the next to enable sequential closing of the flow valves 44 as each sequential well section 42 is treated. It should be noted, however, that other types of valves or mechanisms can be used to control the flow of treatment fluid through the tubing string and into each well section 42.

In the example illustrated in FIG. 2, each screen assembly 28 comprises a screen 54 and one or more isolation valves 56 that are integral with each screen 54. As illustrated, some of the screen assemblies 28 may comprise a single isolation valve 56 and other screen assemblies may comprise a plurality of isolation valves 56 depending on, for example, the size of the well section 42 disposed between sequential packers 40. In this embodiment, each isolation valve 56 comprises a sliding sleeve 58 and a ball seat 60 that works in cooperation with the sliding sleeve 58. The use of a sliding sleeve 58 that is integral with screen 54 provides conformance control by enabling the reduction or blockage of production at select well sections 42. For example, an individual sliding sleeve 58 can be actuated to block flow through a given screen assembly 28 when undesirable fluid/gases are produced at the corresponding well section later in the life of the well.

Once well system 20 is deployed in wellbore 22, a gravel pack 62 can be formed in the annulus surrounding each screen 54. The gravel pack 62 is held in the annulus by the mechanical envelope of the screens 54 and the surrounding formation 30 and acts as a filter media in addition to the screen 54. The gravel packs 62 can be formed in an open hole or a cased hole. In the embodiment illustrated in FIG. 2, for example, the wellbore 22 is cased with a wellbore casing 64 having perforated regions 66 through which fluid is communicated between formation 30 and wellbore 22 during injection or production of fluids. Gravel slurry, fracturing fluid, or other treatment fluids can be delivered to the desired well sections 42 via an appropriate service tool 67. As illustrated, service tool 67 may comprise a tubing, e.g. coiled tubing, run down through the center of tubing string 32.

Figure 3:
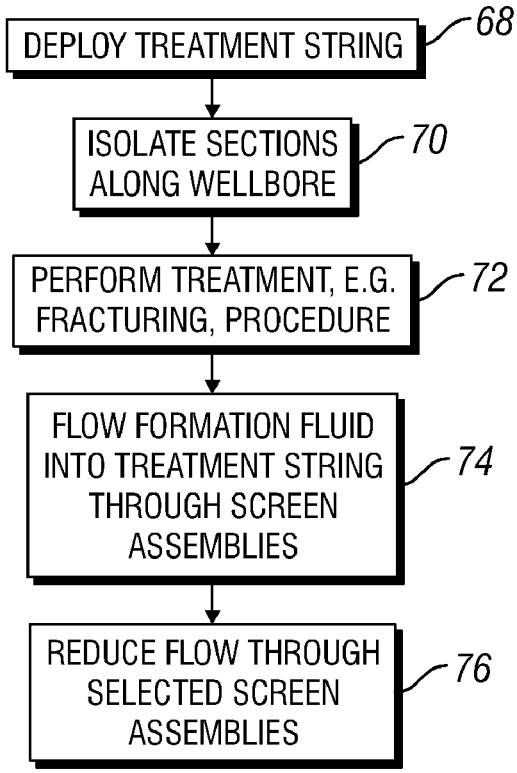
FIG. 3 is a flowchart illustrating a procedure for using the well system, according to an embodiment of the present invention.

The well system 20 can be used in a variety of well treatment and production applications. In one application example, the treatment string 32 is initially deployed in wellbore 22, as illustrated by block 68 in the flowchart of FIG. 3. Once the screen assemblies 28 and flow valves 44 are deployed in the wellbore, the well sections are isolated along wellbore 22 via packers 40, as illustrated by block 70. At this stage of the process, a treatment procedure can be carried out, as illustrated by block 72. The treatment procedure may comprise a fracturing procedure in which a fracturing fluid is injected at each well section 42 via the flow valve 44 located in that specific well section. In addition or alternatively, the treatment procedure may comprise a packing procedure, e.g. a gravel packing procedure, in which gravel packs 62 are formed in each well section 42. The multi-stage treatment system 24 and its flow valves 44 can be used to allow placement of proppant into the annulus sections surrounding screen assemblies 28.

After completing the desired well treatment or treatments, a desired formation fluid can be flowed into wellbore 22 and into tubing string 32 via the screen assemblies 28, as illustrated by block 74. The isolation valves 56 of screen assemblies 28 can be used to restrict or close off flow through specific screen assemblies as desired to improve production, as illustrated by block 76. For example, one or more of the well sections 42 may begin to produce gas, water or other undesirable fluids at some point during the life of the well. The use of integral isolation valves 56 enables an operator to selectively block the inflow of these undesirable fluids through the corresponding screen 54 when the corresponding well section 42 no longer adequately produces the desired production fluid, e.g. oil.

Figure 4:
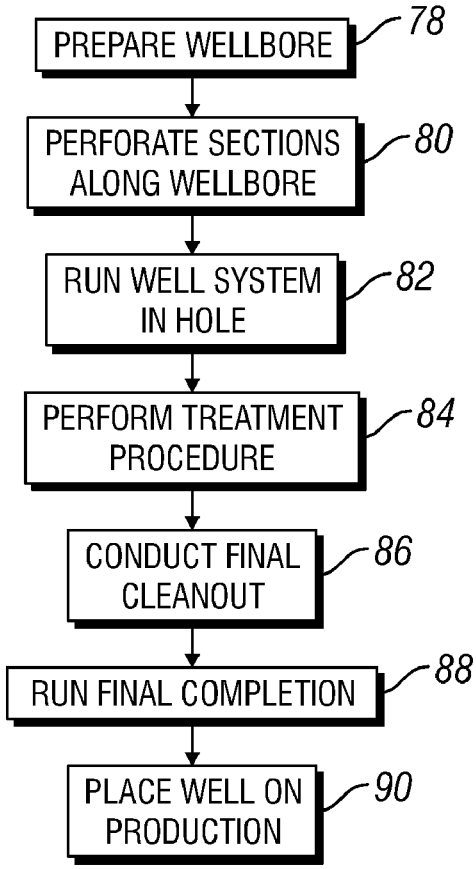
FIG. 4 is a flowchart illustrating another aspect of using the well system, according to an embodiment of the present invention.

Depending on the environment and the completions used to produce fluids from formation 30, the procedures for stimulation and production can be adjusted. In FIG. 4, another example of a procedure for treating a well and producing from the well is illustrated in flowchart form. In this example, the well is initially prepared, as illustrated by block 78. Preparation of the well may involve drilling the well, casing the well, removing an old completion from an existing well, reducing the amount of completion skin to provide each interval/section with an opportunity to be produced to its full capacity, or other procedures designed to facilitate well treatment and production. The well may be prepared, for example, in sand bodies of multiple low-pressure, weak formations. The well also may be prepared in mature fields that are intended for production from multiple zones via an artificial lift mechanism, such as a high rate electric submersible pumping system.

Once the wellbore is prepared, perforations 66 are formed in each of the well sections 42, as illustrated by block 80. The well system is then run in hole, as illustrated by block 82, and the packers 40 are set to isolate well sections 42. A treatment procedure can then be performed in each isolated well section 42, as illustrated by block 84. By way of example, the treatment procedure may comprise sequentially performing a fracturing procedure and/or packing procedure at each of the isolated well zones 42. Following the treatment procedure, a final clean out of the wellbore can be conducted, as illustrated by block 86.

A final completion is then run downhole, as illustrated by block 88. The final completion may comprise a variety of production related completions, including completions designed for artificially lifting production fluids to a desired collection location. For example, an electric submersible pumping system can be delivered downhole to pump the fluids that collect within the well system 20. With the final completion in place, the well can be placed on production to deliver production fluids to the desired collection location, as illustrated by block 90. During production, the sliding sleeves 58 of screen assemblies 28 focus the fluid production and thus facilitate identification of well sections 42 that have high water cut or high gas influx.

As described above, well system 20 can be constructed in a variety of configurations for use in many environments and applications. Additionally, the size and arrangement of the components can be adjusted according to the environment and according to treatment or production parameters. A variety of packers or other isolation devices can be used in both open hole and cased hole applications. Also, various types of screens 54 and isolation valves 56 can be used in the screen assemblies 28. For example, the isolation valves 56 may comprise a variety of valve types that can be actuated between open flow and closed flow configurations. In some embodiments, the isolation valves 56 may selectively be actuated to positions of reduced flow in which some flow is allowed. Additionally, flow valves 44 can be selected to accommodate a variety of treatment fluids and treatment procedures.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A well system, comprising:

a tubular structure deployed in a wellbore;

a plurality of packers deployed in an annulus surrounding the tubular structure to divide the wellbore into isolated sections;

a plurality of flow valves arranged on the tubular structure to provide at least one flow valve in each isolated section to control flow between an interior of the tubular structure and the annulus, wherein the plurality of flow valves comprises a plurality of sliding sleeves; and a plurality of screen assemblies deployed on the tubular structure with at least one screen assembly in each isolated section, each screen assembly having an isolation valve to control flow between the annulus and the interior of the tubular structure.

2. The well system as recited in claim 1, wherein each isolation valve comprises a sliding sleeve.

3. The well system as recited in claim 1, further comprising a gravel pack deposited around each screen assembly.

4. The well system as recited in claim 1, wherein each flow valve comprises one or more of a ball seat or a dart seat.

5. The well system as recited in claim 1, wherein each isolation valve comprises one or more of a ball seat or a dart seat.

6. The well system as recited in claim 1, wherein the plurality of packers comprises open hole packers.

7. A method to improve production from a well, comprising:

deploying a tubular structure in a wellbore;

isolating a plurality of sections along an annulus surrounding the tubular structure;

performing a fracturing procedure at each section by delivering a fracturing fluid down through the tubular structure and out through a flow valve at each section;

flowing a product fluid into the tubular structure at each section through a screen assembly having an isolation valve; and selectively closing isolation valves to block flow through specific screen assemblies.

8. The method as recited in claim 7, wherein isolating comprises actuating a plurality of packers.

9. The method as recited in claim 8, wherein actuating comprises actuating open hole packers.

10. The method as recited in claim 7, wherein performing comprises sequentially fracturing each section.

11. The method as recited in claim 7, further comprising gravel packing around each screen assembly.

12. A well system, comprising:

a multi-stage fracturing system deployed in a wellbore to fracture a plurality of sections along the wellbore, wherein the multi-stage fracturing system comprises a plurality of packers to isolate the plurality of sections along the wellbore and a plurality of flow valves through which fracturing fluid is directed into the surrounding formation at selected sections;

a plurality of screen assemblies positioned at the plurality of sections, each screen assembly having a valve to control flow into the screen assembly; and a tubular structure that carries the plurality of packers, the plurality of flow valves, and the plurality of screen assemblies;

wherein each valve and each flow valve comprises a sliding sleeve.

13. The well system as recited in claim 12, further comprising a tubular structure that carries the plurality of packers, the plurality of flow valves, and the plurality of screen assemblies.

14. The well system as recited in claim 13, further comprising a gravel pack deposited around each screen assembly.

15. A method, comprising:

positioning packers along a tubular to create a plurality of sections;

mounting a fracture fluid flow valve in each section of the plurality of sections wherein the flow valve comprises a sliding sleeve;

locating a screen assembly in each section of the plurality of sections;

providing each screen assembly with a valve to control flow through the screen assembly;

actuating the packers within a wellbore to isolate the plurality of sections along the wellbore; and sequentially fracturing each section.

16. The method as recited in claim 15, further comprising flowing a production fluid into the tubular through at least one of the screen assemblies.

* * * * *